US007071885B2

(12) United States Patent
Noro et al.

(10) Patent No.: US 7,071,885 B2
(45) Date of Patent: Jul. 4, 2006

(54) ANTENNA APPARATUS

(75) Inventors: Junichi Noro, Akita (JP); Kumeo Sasaki, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/700,620

(22) Filed: Nov. 5, 2003

(65) Prior Publication Data

US 2004/0125035 A1 Jul. 1, 2004

(30) Foreign Application Priority Data

Nov. 5, 2002 (JP) ..... P2002-321515
Sep. 4, 2003 (JP) ..... P2003-312215

(51) Int. Cl.
*H01Q 1/32* (2006.01)

(52) U.S. Cl. ..... 343/713; 343/712

(58) Field of Classification Search ..... 343/711–713, 343/702, 872, 705, 757, 714
See application file for complete search history.

(56) References Cited

U.S. PATENT DOCUMENTS 5,359,337 A * 10/1994 Eguchi ..... 343/765
5,451,965 A * 9/1995 Matsumoto ..... 343/702
5,805,113 A * 9/1998 Ogino et al. ..... 343/713
5,909,653 A * 6/1999 Imura et al. ..... 455/575.7
6,034,643 A * 3/2000 Nishikawa et al. ..... 343/765
6,249,254 B1 * 6/2001 Bateman et al. ..... 343/700 MS
6,342,859 B1 * 1/2002 Kurz et al. ..... 343/702
6,636,181 B1 * 10/2003 Asano et al. ..... 343/702
6,786,409 B1 * 9/2004 Fujii et al. ..... 235/451
6,807,437 B1 * 10/2004 Andrus et al. ..... 455/575.7
6,861,994 B1 * 3/2005 Desargant et al. ..... 343/765
6,942,149 B1 * 9/2005 Fujii et al. ..... 235/451
2002/0044164 A1 * 4/2002 Kaburagi ..... 347/2
2002/0080078 A1 * 6/2002 Trumbull et al. ..... 343/702

FOREIGN PATENT DOCUMENTS

JP 2003-37430 2/2003

* cited by examiner

*Primary Examiner*—Shih-Chao Chen
*Assistant Examiner*—Hung Tran Vy
(74) *Attorney, Agent, or Firm*—Whitham, Curtis, Christofferson & Cook, PC

(57) ABSTRACT

An antenna apparatus includes an antenna element having directivity in a vertex direction, an antenna case containing the antenna element, an antenna base coupled to the antenna case, and attached onto an installation face, and an angle regulator adjusting a relative angle between the antenna case and the antenna base.

24 Claims, 9 Drawing Sheets

ANTENNA APPARATUS

BACKGROUND OF THE INVENTION

The present invention relates to an antenna apparatus and more particularly to an antenna apparatus which is mounted, for example, in the interior of a motor vehicle, and enables good sensitivity to be secured.

A typical on-board antenna apparatus is mounted in any position inside a vehicle, preferably mounted near the window of the vehicle. The antenna apparatus is installed with a helical antenna element in the form of a helical conductor, for example. The helical antenna element is an omnidirectional antenna element as shown by a radiation pattern in FIG. 11, for example. The mounting of the antenna element is carried out by attaching the base of an antenna case securely onto a portion inside a motor vehicle normally with a double-sided tape, an adhesive, machine screws and so forth. (refer to JP-A-2003-37430)

Such an on-board antenna apparatus is adapted to receive various signals including global positioning system (GPS) signals, satellite radio broadcasting signals, cellular telephone signals and the like.

As described above, the on-board antenna apparatus employing the helical antenna element is usually an omnidirectional antenna. However, regarding the directional sensitivity of the antenna apparatus, it is difficult to secure optimum sensitivity when the antenna apparatus is actually installed because the antenna apparatus is mounted inside the vehicle but not set in such an environment that a shielding member is existent. Moreover, since the mounting of the antenna apparatus is carried out by attaching the base of the antenna case securely onto any planar face in the interior of the vehicle as described above, the antenna apparatus for use cannot be tilted in the direction toward a satellite after the antenna apparatus is installed in the interior of the vehicle.

SUMMARY OF THE INVENTION

It is therefore an object of the present invention to provide an antenna apparatus whose angle is freely adjustable even after the antenna apparatus is installed in the interior of a motor vehicle, for example, in order to make optimum sensitivity available.

In order to achieve the above object, according to the present invention, there is provided an antenna apparatus, comprising:

an antenna element, having directivity in a vertex direction;

an antenna case, containing the antenna element;

an antenna base, coupled to the antenna case, and attached onto an installation face; and an angle regulator, adjusting a relative angle between the antenna case and the antenna base.

In the above configuration, the relative angle between the antenna case and the antenna base is adjusted via the angle regulator so that the sensitivity of the antenna element is optimized.

Preferably, the antenna apparatus further includes a driving unit, driving the angle regulator so as to mechanically adjust the relative angle between the antenna case and the antenna base.

Here, it is preferable that, the antenna apparatus further includes a detector, detecting a condition of radio-wave received by the antenna element, and a controller, controlling the driving unit based on the condition of the radio-wave detected by the detector.

Preferably, the angle regulator includes a plunger, a receiving portion having a plurality of depressions for latching the plunger, and a resilient member urging the plunger to the receiving portion. Here, it is preferable that, the depressions are formed on the receiving portion at regular intervals.

In the above configuration, the relative angle between the antenna case and the antenna base is automatically adjusted so that the sensitivity of the antenna element is optimized.

Preferably, a hook hole is formed in a base face of the antenna base. Here, it is preferable that, the hook hole has a large-diameter hole portion and narrow slit portions which formed on both sides of the large-diameter portion. Here, it is preferable that, the hook hole has a plurality of hook holes. The hook holes are formed in four places corresponding to four corners of the base face which is attached onto the installation face. Here, it is preferable that, a cable hole is formed in the base face of the antenna base so that a cable is drawn out from the cable hole toward an upper side or a lower side of the antenna base. Here, it is preferable that, a cable drawing-out groove is formed in the base face of the antenna base so as to extend to the upper side or the lower side of the antenna base. A cable latch portion is formed in the base face of the antenna base so as to latch the cable which is drawn out along the groove.

In the above configuration, the antenna base can be mounted upwardly or downwardly.

Preferably, the installation face is formed on an interior of a vehicle. In other words, the antenna apparatus is a vehicle antenna apparatus mounted inside of a vehicle.

In the above configuration, the angle of the antenna element is adjustable so that the sensitivity of the antenna element is optimized.

Also, as the hook holes are provided additionally, the cable can be drawn out of an upper or a lower side, whereby installation freedom is increased.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

An antenna apparatus according to the invention will now be described in detail by reference to the accompanying drawings.

Figure 1A:
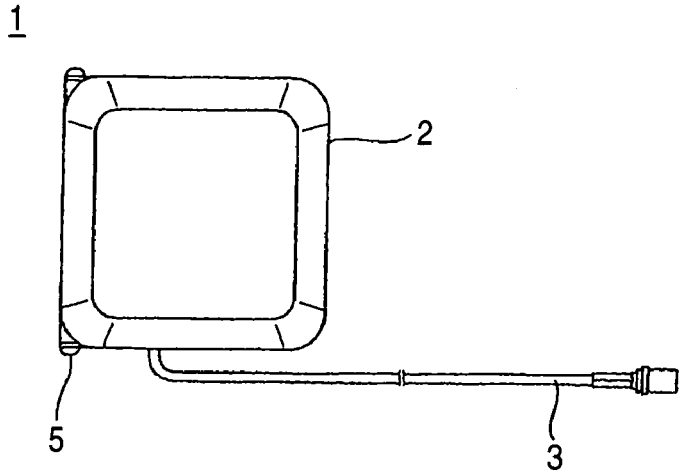
FIG. 1A is a top view of an antenna apparatus according to the invention.
Figure 1B:
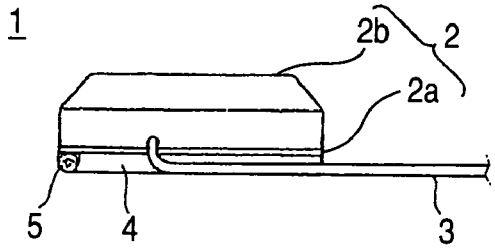
FIG. 1B is a side view of the antenna apparatus according to the invention.
Figure 1C:
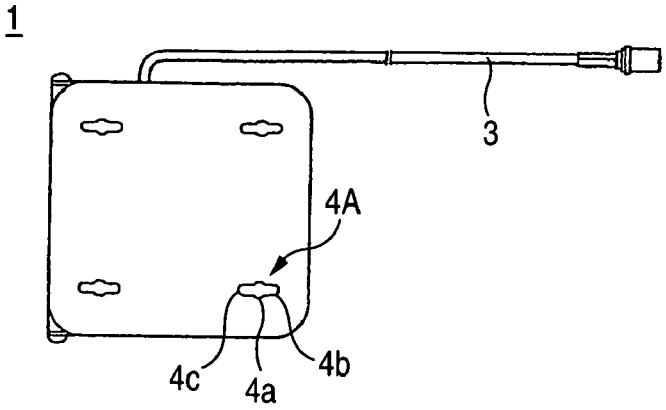
FIG. 1C is a bottom view of the antenna apparatus according to the invention.

FIGS. 1A to 1C is an external view of an antenna apparatus 1 according to the invention. FIG. 1A is a top view of the antenna apparatus 1 as seen from the vertex direction, FIG. 1B is a side view of the antenna apparatus 1 as seen from its side, and FIG. 1C is a bottom view of the antenna apparatus 1 as seen from its base side. The antenna apparatus 1 shown in this illustrative example is mounted on any planar face inside a motor vehicle, preferably mounted on a planar face near the window of the motor vehicle and used to receive radio waves for transmitting GPS signals, satellite radio broadcasting signals, cellular telephone signals and the like.

Figure 2:
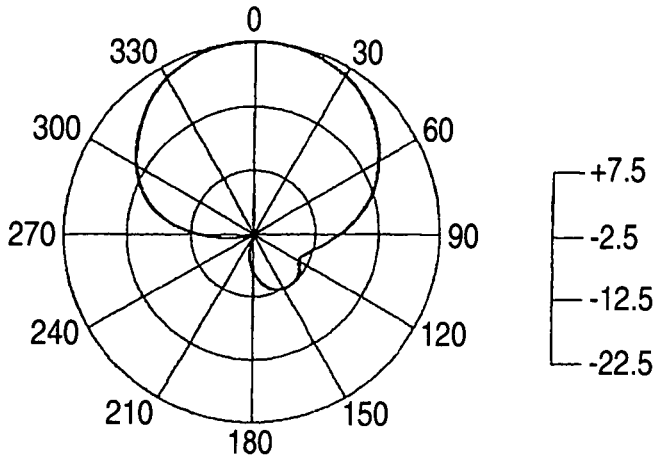
FIG. 2 is a diagram showing the directivity of an antenna element that the antenna apparatus has according to the invention.

The antenna apparatus 1 has an antenna element having directivity in the vertex direction. FIG. 2 shows an example of the directivity of the antenna element. The antenna apparatus 1 has an antenna case 2 for containing the antenna element. The antenna case 2 may contain not only the antenna element but also a circuit board on which a low noise amplifier (LNA) for amplifying the signal received by the antenna element is formed. Incidentally, the adoption of the antenna element for the antenna apparatus 1 permits the antenna case 2 to be planar in schematic configuration, thus improving design property.

As shown in FIG. 1B, the antenna case 2 has a bottom cover 2*a* on which the antenna element is mounted and a top cover 2*b* for covering the antenna element. An opening for a cable 3 is formed in the side of the top cover 2*b* and one end of the cable 3 is connected to the antenna element or the circuit board within the antenna case 2. The other end of the cable 3 is connected to any other apparatus (not shown) in the interior of the vehicle such as a channel selection device or the GPS.

Further, the antenna apparatus 1 has an antenna base 4 attached securely onto any installation face. As shown in FIG. 1C, hook holes 4A are formed in the antenna base 4, whereby the antenna apparatus 1 can be hung on the wall. Each hook howl 4A has a large-diameter portion 4*a* into which a hook (illustration omitted) provided on the wall is inserted and narrow universal slit portions 4*b* and 4*c* formed on both sides of the large-diameter portion 4*a*. The antenna apparatus 1 is prevented from inadvertently falling off by inserting each hook into the large-diameter portion 4*a* and then sliding the hook toward the slit portion 4*b* or 4*c*. In this case, as each hook hole 4A has the universal slit portions 4*b* and 4*c* formed on both sides of the large-diameter portion 4*a*, the antenna base 4 can be hung on the wall upwardly or downwardly.

Although it is normally assumed for an antenna apparatus of this type to be placed on the floor, the universal hook holes 4A according to the embodiment of the invention permits the antenna apparatus to be hung on the wall and also permits the antenna base to be mounted upwardly or downwardly since the universal hook holes 4A is formed in the antenna base 4. Therefore, the antenna apparatus according to this embodiment of the invention is adapted for diverse conditions of installation; for example, the antenna apparatus can be mounted on a vertical wall face or otherwise mounted slantwise.

The antenna case 2 including the bottom cover 2*a* and the top cover 2*b* is coupled to the antenna base 4 via screws 5. The screws are used to couple the antenna case 2 and the antenna base 4 together in such a manner as to make adjustable the relative angle therebetween.

Figure 3A:
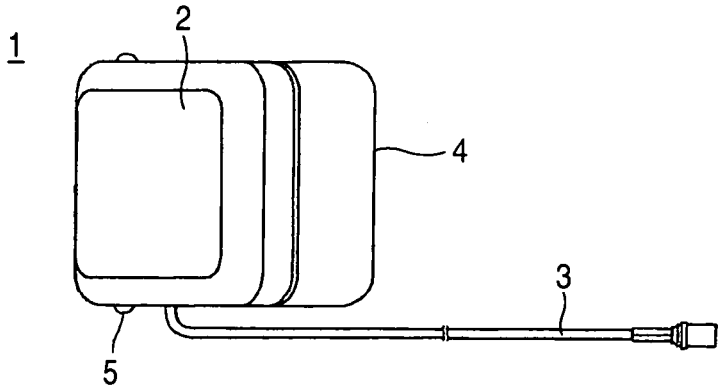
FIG. 3A is a top view showing a condition in which the angle of an antenna case of the antenna apparatus shown in FIGS. 1A to 1C.
Figure 3B:
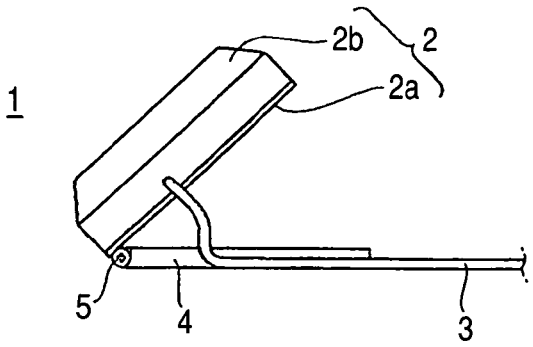
FIG. 3B is a side view showing the condition above.

FIGS. 3A to 3B show the antenna case 2 in an opened condition, that is, a condition in which the relative angle of the antenna case 2 to the antenna base 4 has been adjusted. FIG. 3A is a top view of the antenna apparatus 1 corresponding to FIG. 1A, and FIG. 3B is a side view of the antenna apparatus 1 corresponding to FIG. 1B.

As is obvious from FIG. 3B in particular, the relative angle of the antenna case 2 to the antenna base 4 indicates the angle formed between the plane defined by the base of the bottom cover 2*a* of the antenna case 2 and the plane defined by the top face of the antenna base 4. In this illustrative example, the screws 5 are used to couple the antenna case 2 and the antenna base 4 together so as to make adjustable the angle therebetween in a range of 0° to 90°.

The antenna base 4 can be attached securely onto any planar face inside the motor vehicle through various known techniques using a magnet, a double-sided tape, an adhesive, screws and so forth. In the simplest mode, a user mounts the antenna base 4 on any planar face inside the motor vehicle and then manually adjusts the relative angle of the antenna case 2 to the antenna base 4. In case that the antenna apparatus 1 is an antenna apparatus for receiving satellite broadcasting signals, for example, the user is permitted to adjust the antenna case to an optimum angle so as to gain the highest sensitivity while voluntarily confirming the sound quality of audio information actually received.

A hinge mechanism in place of the screws 5 may be provided so as to make the angle adjustment electrically by coupling a known driving mechanism such as a motor, a pump or the like to the hinge mechanism. Moreover, there may be provided a control circuit for controlling the driving mechanism for driving the hinge mechanism. A description will subsequently be given of an illustrative example of automatically adjusting the relative angle between the antenna case 2 and the antenna base 4 without any operation on the part of a user by reference to FIG. 4.

Figure 4:
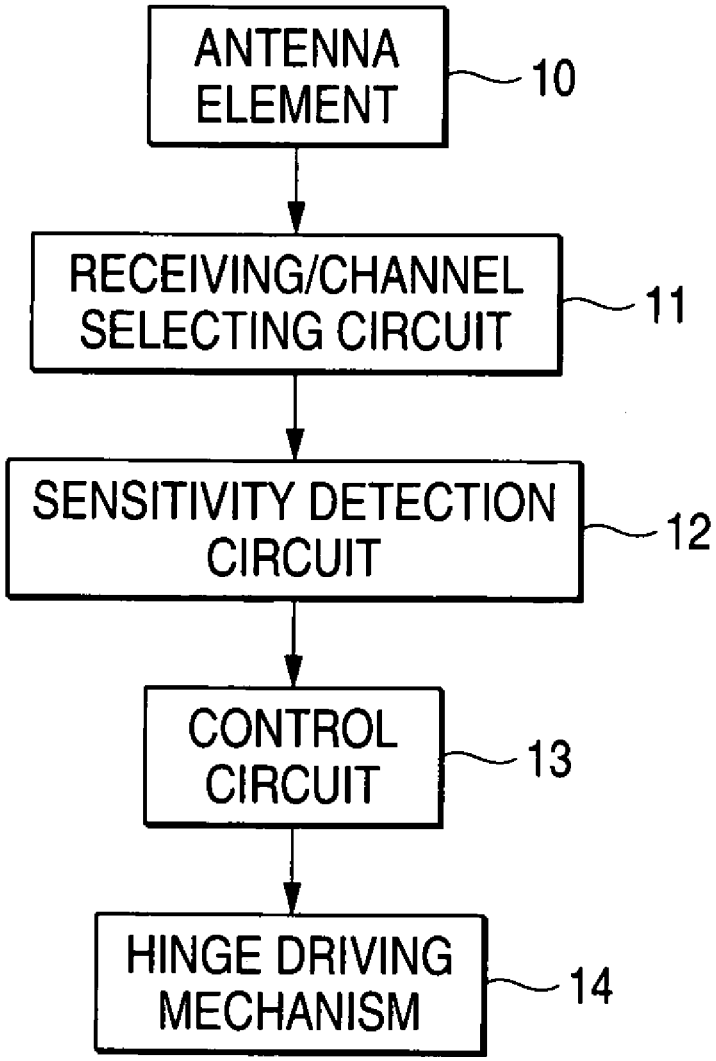
FIG. 4 is a block diagram of a circuit for automatically controlling the angle of the antenna case based on the sensitivity of the antenna element.

In the illustrative example shown in FIG. 4, an antenna element 10 contained in the antenna case 2 of the antenna apparatus 1 described above receives satellite radio broadcasting signals and supplies the received satellite radio broadcasting signals, for example, to a receiving/channel selecting circuit 11. In this case, a low noise amplifier for amplifying feeble signals received by the antenna element 10 may be provided between the antenna element 10 and the receiving/channel selecting circuit 11.

The receiving/channel selecting circuit 11 has a band pass filter and an amplifier. The receiving/channel selecting circuit 11 subjects signals in predetermined frequency bands corresponding to predetermined channels to processing such as down conversion, demodulation and amplification. As this circuit is similar to a circuit that any ordinary radio signal receiver is equipped with, the detailed description thereof will be omitted. The receiving/channel selecting circuit 11 supplies to a sensitivity detection circuit 12 the audio signal obtained by subjecting the signal received by the antenna element 10 to the processing above.

The sensitivity detection circuit 12 detects the power and signal-to-noise ratio of the audio signal supplied from the receiving/channel selecting circuit 11, whereby to detect the reception sensitivity of the antenna element 10 and supplies a signal indicating the reception sensitivity thus detected to a control circuit 13.

The control circuit 13 controls a hinge driving mechanism 14 according to the signal supplied from the sensitivity detection circuit 12. The hinge driving mechanism 14 drives the hinge mechanism of the antenna apparatus by an electric motor, for example, and changes the relative angle between the antenna case 2 and the antenna base 4.

The antenna element 10 is an antenna element having directivity in the vertex direction as described above. Therefore, the sensitivity of the antenna element 10 is also varied with the change of the relative angle between the antenna case 2 and the antenna base 4. Since the sensitivity of the antenna element 10 is detected by the sensitivity detection circuit 12 as described above, the control circuit 13 receives the relation between the relative angle of the antenna case 2 to the antenna base 4 and the sensitivity of the antenna element 10.

Therefore, the control circuit 13 can control the hinge driving mechanism 14 by varying the relative angle between the antenna case 2 and the antenna base 4 from 0° to 90° by degrees in order to confirm the sensitivity of the antenna element 10 and by finding out an angle at which the sensitivity of the antenna element 10 is optimized so that the antenna case 2 is held at that angle.

Control like this may initially be performed only once after the antenna apparatus 1 is mounted in the interior of the motor vehicle or every time the power supply of audio equipment connected to the antenna apparatus 1 is turned on or at predetermined time intervals during the time the antenna apparatus 1 is in operation or at any time while the sensitivity of the antenna element 10 is monitored regularly.

In this illustrative example, the relative angle between the antenna case 2 and the antenna base 4 is precisely adjusted so that the sensitivity of the antenna element 10 is optimized without causing the user to be voluntarily involved in making such an adjustment.

Figure 5:
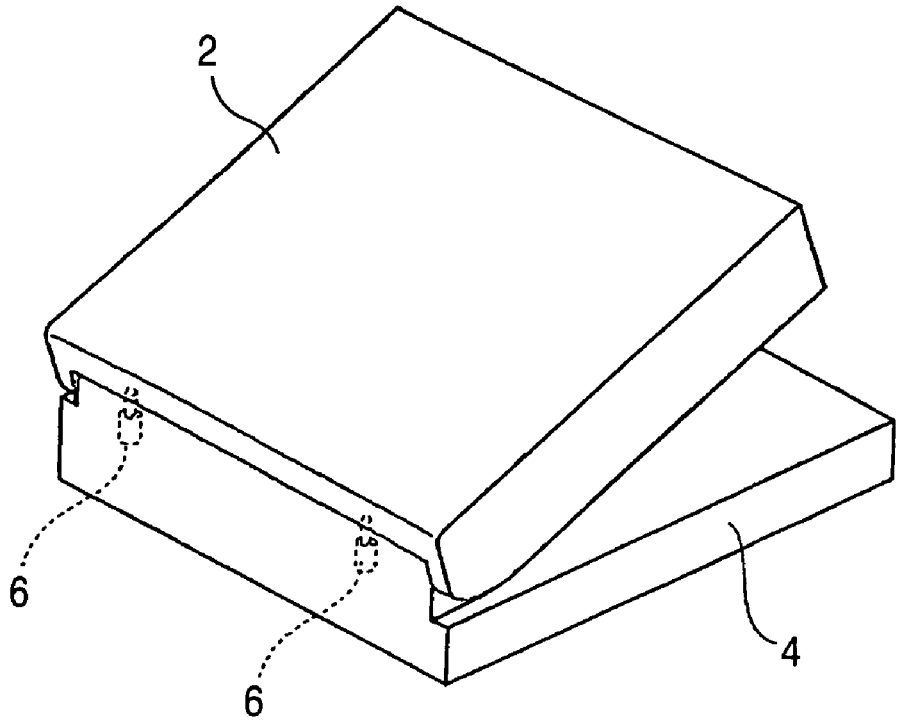
FIG. 5 is a perspective view showing an example of the antenna apparatus provided with plungers as an angle regulating mechanism.
Figure 6A:
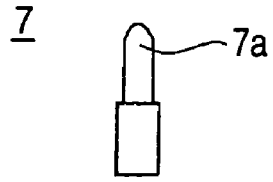
FIG. 6A is a side view of a rotating shaft of the structure of the plunger.
Figure 6B:
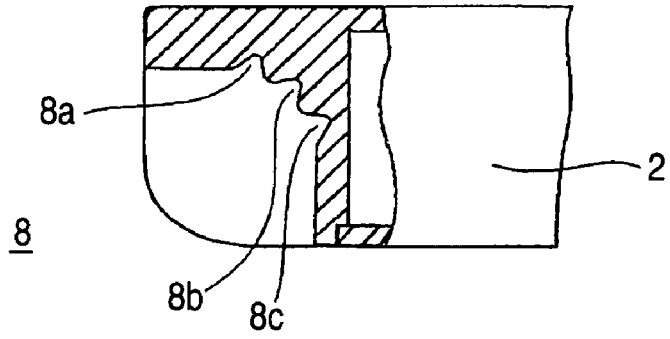
FIG. 6B is a side view of a receiving portion of the structure of the plunger.

FIG. 5 shows another example of the angle regulating mechanism. As shown in FIG. 5, the antenna case 2 and the antenna base 4 are coupled together via plungers 6. The plunger 6 includes a rotating shaft 7 shown in FIG. 6A and a receiving portion 8 for holding the rotating shaft 7 shown in FIG. 6B. The plungers 6 function as those making the angle variable by 90°.

Figure 6C:
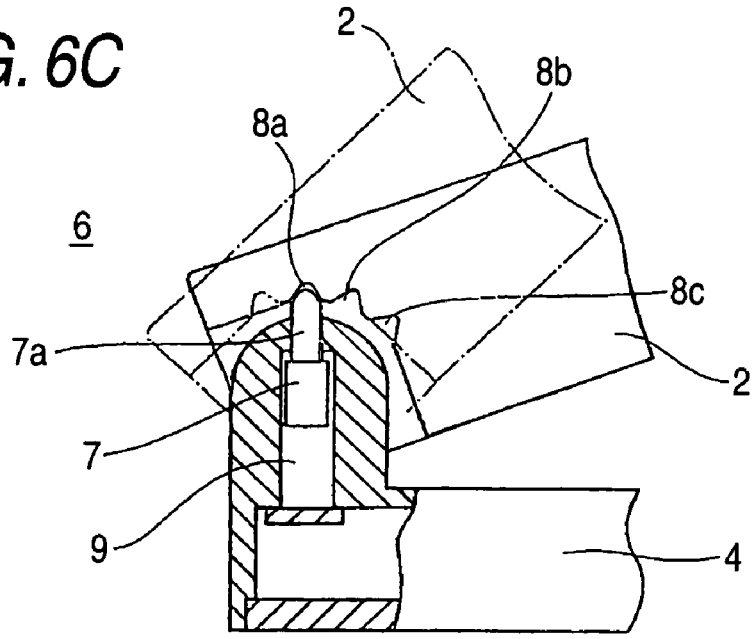
FIG. 6C is a side view showing a compression arrangement by the spring of the rotating shaft.

The rotating shaft 7 has a tip 7*a* in the form of a spherical face and is urged by a spring 9 against the receiving portion 8 as shown in FIG. 6C. The receiving portion 8 is formed with a plurality of depressions 8*a*, 8*b* and 8*c* (three in this case) arranged at equal angular intervals and fixed in such a condition that the tip 7*a* of the rotating shaft 7 is fitted into one of the depressions 8*a*, 8*b* and 8*c*, thereby a clickable angle adjustment is possible. When the rotating shaft 7 is fixed by the depression 8*a*, for example, the angle of the antenna case 2 is adjusted to such a condition that the antenna case 2 is tilted by 15° from the vertical direction with respect to the antenna base 4. When the rotating shaft 7 is fixed by the depression 8*b*, the angle of the antenna case 2 is adjusted to such a condition that the antenna case 2 is tilted by 45° from the vertical direction with respect to the antenna base 4.

With the arrangement thus adopted as described above, the antenna case 2 can readily be set at any given angle with respect to the antenna base 4 by allowing the user to take a proper step in pivoting the antenna case 2. When the operation of pivoting the antenna case 2 is performed, the rotating shaft 7 is pressed down against the resilient force of the spring 9 and moved into one of the depressions 8*a*–8*c*. In this case, it is feasible to make a finer angle adjustment by increasing the number of depressions formed in the face of the receiving portion 8.

Although the specific form of the antenna apparatus embodied in the invention has been described, the invention is not limited to the embodiment thereof but may needless to say be changed and modified in various manners.

Although it has been arranged that the cable 3 is drawn out of the side of the antenna case 2 in the embodiment of the invention, the cable 3 may be drawn out of the base of the antenna base 4 and also drawn out of either top or bottom depending on the direction in which the antenna apparatus is mounted via the hook holes 4A. Accordingly, a method of drawing out the cable 3 from the base of the antenna base 4 will be described hereinbelow.

Figure 7:
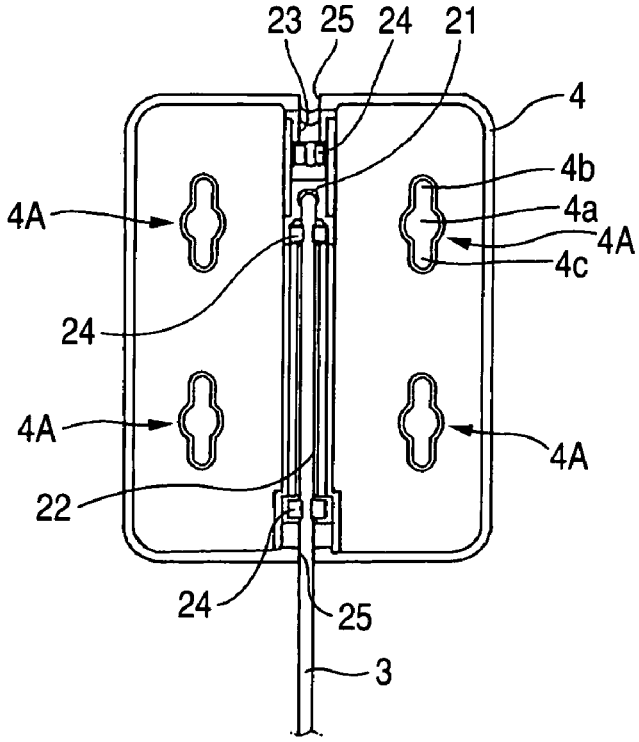
FIG. 7 is a bottom view of an antenna base so configured as to draw out a cable from the base of the antenna base.

FIG. 7 shows another example of the antenna base 4. The hook hole 4A is provided in four places in the base of the antenna base 4 and each hook hole 4A has the universal slit portions 4*b* and 4*c* formed on both sides of the large-diameter portion 4*a* as in the embodiment of the invention shown in FIGS. 1A to 1C.

In this example, a cable drawing-out port 21 is formed in the base of the antenna base 4 and the cable 3 is drawn out of the cable drawing-out port 21. In this case, cable grooves 22 and 23 linearly stretching with the cable port 21 held therebetween are respectively formed in the upper and lower sides of the cable port 21 as groove portions substantially semicircular in cross section.

Substantially U-shaped cable latching parts 24 slightly smaller in diameter than the cable 3 are formed integrally with the inner wall of the antenna base 4 in the mid-positions of the respective cable grooves 22 and 23. The cable 3 is thus made stably supportable by sandwiching the cable 3 with these cable latching parts 24. The cable latching parts 24 are formed at proper intervals in proportion to the lengths of the cable grooves 22 and 23, namely, the cable latching part 24 is provided in two places on the side of the long cable groove 22 and one place on the side of the short cable groove 23 in the base of the antenna base 4. In this case, the cable latching part 24 may be omitted in case that the cable groove on the side of the short cable groove 23 is short.

Figure 8A:
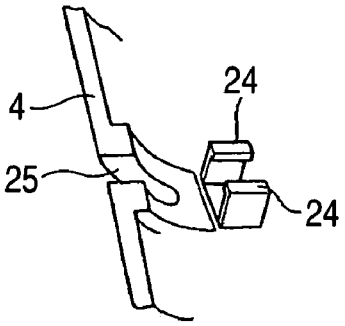
FIG. 8A is a partial perspective view showing configurations of a cutout and a cable latching part provided in the outer peripheral wall of the antenna base.
Figure 8B:
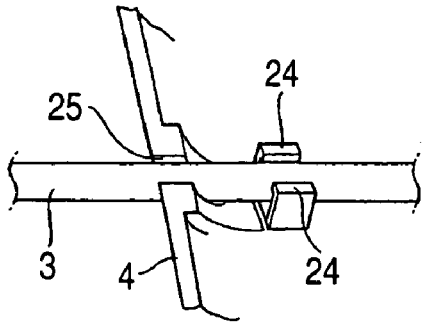
FIG. 8B is a partial perspective view of the cable in a latched condition.

A substantially U-shaped cutout 25 is formed in the outer peripheral wall of the antenna base 4 in the exit position of each of the cable grooves 22 and 23. The cable 3 is drawn outside from the cutout 25. FIGS. 8A to 8B show a condition in which the cable 3 is supported in the vicinity of the cutout 25. As shown in FIG. 8A, the cutout 25 is formed in the outer peripheral wall of the antenna base 4. However, the cutout 25 is slightly smaller in diameter than the cable 3, too. Consequently, as shown in FIG. 8B, the cable 3 is forced into the cable latching part 24 as well as the cutout 25 by utilizing the pliability of a resin film for covering the cable 3 in order to obtain a stable latched condition of the cable 3.

As described above, the cable grooves 22 and 23 are formed in the base of the antenna base 4 and the cable latching parts 24 and the cutouts 25 are also formed therein, whereby when the antenna apparatus is hung on the wall by the universal hook holes 4A, for example, the direction of drawing out the cable 3 can be changed in agreement with the mounting direction.

Figure 9A:
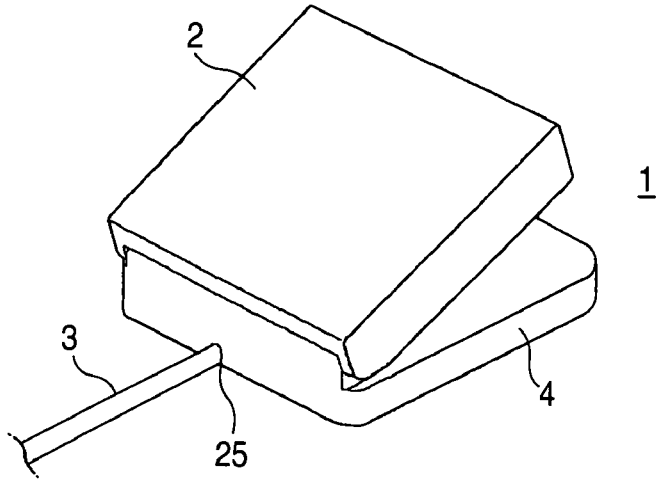
FIG. 9A is a perspective view of the cable drawn out of the front side of the antenna base.
Figure 9B:
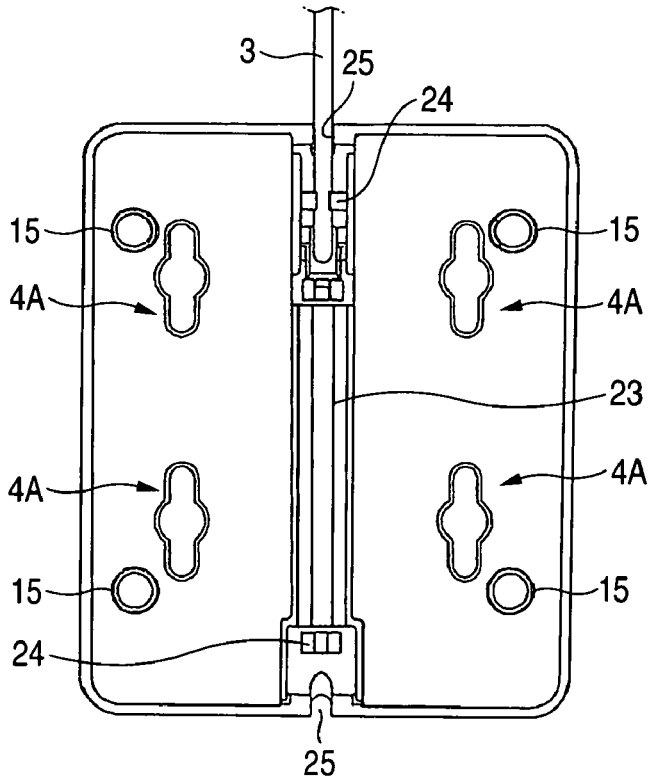
FIG. 9B is a bottom view of the cable drawn out of the front side of the antenna base.

FIGS. 9A and 9B show a condition in which the cable 3 is drawn out of the front side of the antenna base 4. In this case, as shown in FIG. 9B, it is only needed to draw out the cable 3 from the side of the short cable groove 23.

Figure 10A:
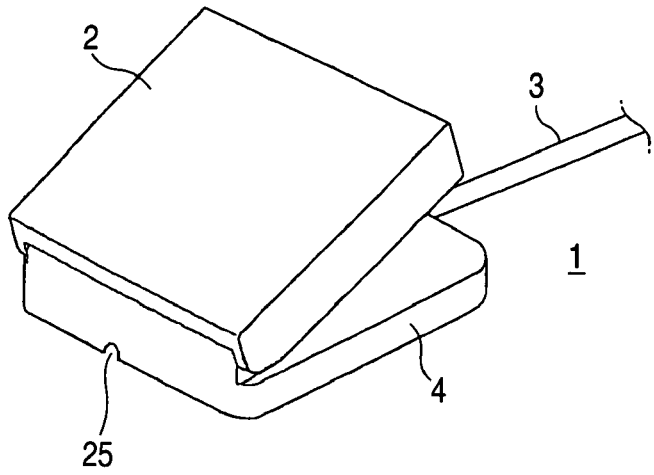
FIG. 10A is a perspective view of the cable drawn out of the rear side of the antenna base.
Figure 10B:
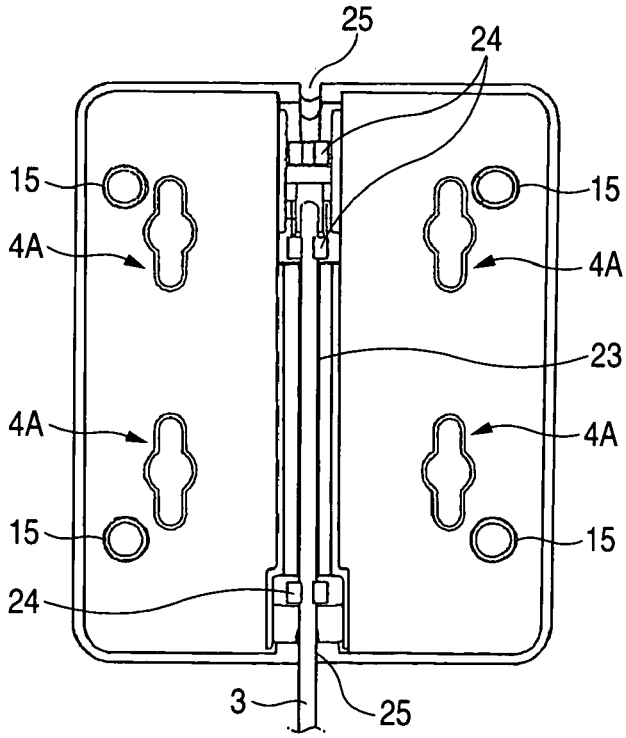
FIG. 10B is a bottom view of the cable drawn out of the rear side of the antenna base.
Figure 11:
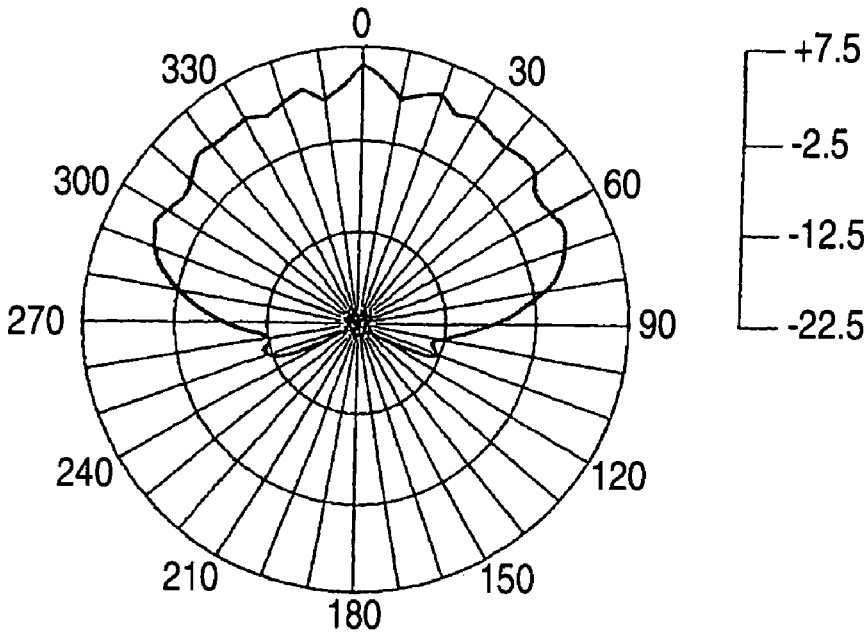
FIG. 11 is a diagram showing the directivity of a related helical antenna element.

FIGS. 10A and 10B show a condition in which the cable 3 is drawn out of the front side of the antenna base 4. In this case, as shown in FIG. 10B, it is only needed to draw out the cable 3 from the side of the long cable groove 22.

As the cable 3 can be drawn out of either front or rear side of the antenna base 4, the cable 3 can thus be drawn out according to circumstances, depending on the direction of mounting the antenna apparatus by the hook holes 4A, and it is possible to deal with diverse conditions of installing the antenna apparatus.

Also, as shown in FIGS. 9B and 10B, four rubber slip stoppers 15 are provided at vicinity of each corner of the base face of the antenna base 4. The rubber slip stoppers 15 prevent the antenna apparatus 1 from slipping on the installation face of the vehicle, thereby a stable mounting to the installation face is ensured.

What is claimed is:

1. An antenna apparatus, comprising:

an antenna element;

an antenna case, containing the antenna element;

an antenna base coupled to the antenna case at a fixed end, said antenna base having a face formed with a cable groove, wherein said antenna case is permitted to pivot at said fixed end relative to said antenna base such that a free end of said antenna case moves toward or away from said antenna base during pivoting;

a cable extending from said antenna element to said antenna base and fitting within said cable groove; and an angle regulator for adjusting a relative angle between the antenna case and the antenna base by pivoting said antenna case relative to said antenna base at said fixed end.

2. The antenna apparatus as set forth in claim 1, further comprising a driving unit for driving the angle regulator so as to mechanically adjust the relative angle between the antenna case and the antenna base.

3. The antenna apparatus as set forth in claim 2, further comprising a detector for detecting a condition of radio-wave received by the antenna element; and a controller for controlling the driving unit based on the condition of the radio-wave detected by the detector.

4. The antenna apparatus as set forth in claim 1, wherein the angle regulator includes a plunger, a receiving portion having a plurality of depressions for latching the plunger, and a resilient member urging the plunger to the receiving portion.

5. The antenna apparatus as set forth in claim 1, wherein a hook hole is formed in a base face of the antenna base.

6. The antenna apparatus as set forth in claim 5, wherein the hook hole has a large-diameter hole portion and narrow slit portions which are formed on both sides of the large-diameter portion.

7. The antenna apparatus as set forth in claim 1 wherein a plurality of hook holes are formed in a base face of the antenna base; and wherein the hook holes are formed in four places corresponding to four corners of the base face.

8. The antenna apparatus as set forth in claim 1, wherein a cable hole is formed in the a base face of the antenna base so that a cable is drawn out from the cable hole toward an upper side or a lower side of the antenna base.

9. The antenna apparatus as set forth in claim 8, wherein the cable groove is formed in the base face of the antenna base so as to extend to the upper side or the lower side of the antenna base; and wherein a cable latch portion is formed in the base face of the antenna base so as to latch the cable which is drawn out along the groove.

10. The antenna apparatus as set forth in claim 1 wherein an elastic slip stopper is provided on a base face of the antenna base.

11. The antenna apparatus, comprising:

an antenna element;

an antenna case for containing said antenna element;

an antenna base, coupled to the antenna case at a fixed end, wherein said antenna case is permitted to pivot at said fixed end relative to said antenna base such that a free end of said antenna case moves toward or away from said antenna base during pivoting, wherein said antenna base includes a base face in which is formed a cable groove that extends from a first side to a second side of the antenna base; and a cable extending from said antenna element to said base face of said antenna base and fitting within said cable groove.

12. The antenna apparatus as set forth in claim 11, further comprising an angle regulator for adjusting a relative angle between the antenna case and the antenna base.

13. The antenna apparatus as set forth in claim 1 wherein said antenna element receives satellite broadcasting signals.

14. The antenna apparatus as set forth in claim 1 wherein said antenna regulator operates in a manner which optimizes a sensitivity of the antenna element to a received signal.

15. The antenna apparatus as set forth in claim 1 further comprising a low noise amplifier circuit board, amplifying a signal received by the antenna element, wherein the antenna element and the low noise amplifier circuit board are contained in the antenna case.

16. The antenna apparatus as set forth in claim 11 further comprising a low noise amplifier circuit board, amplifying a signal received by the antenna element, wherein the antenna element and the low noise amplifier circuit board are contained in the antenna case.

17. The antenna apparatus as set forth in claim 11 wherein said cable extends from said antenna case to said base face of said antenna base.

18. The antenna apparatus as set forth in claim 17 wherein the cable passes through an opening or passageway in said antenna base to reach the cable groove in the antenna base.

19. The antenna apparatus as set forth in claim 11 further comprising a latching mechanism within said cable groove for latching said cable in said cable groove.

20. The antenna apparatus as set forth in claim 19 wherein said latching mechanism may either latch said cable in said cable groove so as to extend from said antenna base through said first side or said second side of said antenna base.

21. The antenna apparatus as set forth in claim 11 wherein at least one hook hole is formed in the base face of said antenna base.

22. The antenna apparatus as set forth in claim 11 wherein said antenna element functions for transmitting or receiving signals to or from a device remote from said antenna apparatus.

23. The antenna apparatus as set forth in claim 22 wherein said antenna element receives satellite broadcasting signals.

24. The antenna apparatus as set forth in claim 12 wherein said antenna regulator operates in a manner which optimizes a sensitivity of the antenna element to a received signal.

* * * * *